US008597443B2

(12) United States Patent
Hebda et al.

(10) Patent No.: US 8,597,443 B2
(45) **Date of Patent: *Dec. 3, 2013**

(54) PROCESSING OF TITANIUM-ALUMINUM-VANADIUM ALLOYS AND PRODUCTS MADE THEREBY

(75) Inventors: John J. Hebda, Albany, OR (US); Randall W. Hickman, Jefferson, OR (US); Ronald A. Graham, Salem, OR (US)

(73) Assignee: ATI Properties, Inc., Albany, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/230,143

(22) Filed: Sep. 12, 2011

(65) Prior Publication Data

US 2012/0003118 A1 Jan. 5, 2012

Related U.S. Application Data

(63) Continuation of application No. 11/745,189, filed on May 7, 2007, now Pat. No. 8,048,240, which is a continuation of application No. 10/434,598, filed on May 9, 2003, now abandoned.

(51) Int. Cl.
*C22C 14/00* (2006.01)
*C22F 1/18* (2006.01)

(52) U.S. Cl.
USPC ..... 148/670; 148/421; 148/668; 148/669; 420/417; 420/418; 420/420

(58) Field of Classification Search
USPC ..... 148/421, 668–670; 420/417–418, 420
See application file for complete search history.

(56) References Cited

U.S. PATENT DOCUMENTS

| | | | |
|---|---|---|---|
| 2,857,269 | A | 10/1958 | Vordahl |
| 2,932,886 | A | 4/1960 | Atthouse |
| 3,313,138 | A | 4/1967 | Spring et al. |
| 3,379,522 | A | 4/1968 | Vordahl |
| 3,489,617 | A | 1/1970 | Wuerfel |
| 3,615,378 | A | 10/1971 | Bomberger, Jr. et al. |
| 3,635,068 | A | 1/1972 | Watmough et al. |
| 3,686,041 | A | 8/1972 | Lee |
| 4,053,330 | A | 10/1977 | Henricks et al. |
| 4,067,734 | A | 1/1978 | Curtis et al. |
| 4,094,708 | A | 6/1978 | Hubbard et al. |
| 4,098,623 | A | 7/1978 | Ibaraki et al. |
| 4,147,639 | A | 4/1979 | Lee et al. |
| 4,197,643 | A | 4/1980 | Burstone et al. |
| 4,229,216 | A | 10/1980 | Paton et al. |
| 4,309,226 | A | 1/1982 | Chen |
| 4,482,398 | A | 11/1984 | Eylon et al. |
| 4,543,132 | A | 9/1985 | Berczik et al. |
| 4,631,092 | A | 12/1986 | Ruckle et al. |
| 4,639,281 | A | 1/1987 | Sastry et al. |
| 4,668,290 | A | 5/1987 | Wang et al. |
| 4,687,290 | A | 8/1987 | Prussas |
| 4,688,290 | A | 8/1987 | Hogg |
| 4,690,716 | A | 9/1987 | Sabol et al. |
| 4,714,468 | A | 12/1987 | Wang et al. |
| 4,799,975 | A | 1/1989 | Ouchi et al. |
| 4,808,249 | A | 2/1989 | Eyelon et al. |
| 4,842,653 | A | 6/1989 | Wirth et al. |
| 4,851,055 | A | 7/1989 | Eylon et al. |
| 4,854,977 | A | 8/1989 | Alheritiere et al. |
| 4,857,269 | A | 8/1989 | Wang et al. |
| 4,878,966 | A | 11/1989 | Alheritiere et al. |
| 4,889,170 | A | 12/1989 | Mae et al. |
| 4,943,412 | A | 7/1990 | Bania et al. |
| 4,975,125 | A | 12/1990 | Chakrabarti et al. |
| 4,980,127 | A | 12/1990 | Parris et al. |
| 5,026,520 | A | 6/1991 | Bhowal et al. |
| 5,032,189 | A | 7/1991 | Eylon et al. |
| 5,041,262 | A | 8/1991 | Gigliotti, Jr. |
| 5,074,907 | A | 12/1991 | Amato et al. |
| 5,080,727 | A | 1/1992 | Aihara et al. |
| 5,141,566 | A | 8/1992 | Kitayama et al. |
| 5,156,807 | A | 10/1992 | Nagata et al. |
| 5,162,159 | A | 11/1992 | Tenhover et al. |
| 5,169,597 | A | 12/1992 | Davidson et al. |
| 5,173,134 | A | 12/1992 | Chakrabarti et al. |
| 5,201,457 | A | 4/1993 | Kitayama et al. |
| 5,244,517 | A | 9/1993 | Kimura et al. |
| 5,264,055 | A | 11/1993 | Champin et al. |

(Continued)

FOREIGN PATENT DOCUMENTS

| | | | |
|---|---|---|---|
| CN | 1070230 | A | 3/1993 |
| EP | 0535817 | B1 | 4/1995 |

(Continued)

OTHER PUBLICATIONS

Veeck, S., at el., "The Castability of Ti-5553 Alloy," Advanced Materials and Processes, Oct. 2004, pp. 47-49.

Murray JL, et al., Binary Alloy Phase Diagrams, Second Edition, vol. 1, Ed. Massalski, Materials Park, Oh; ASM International; 1990, p. 547.

Materials Properties Handbook: Titanium Alloys, Eds. Boyer et al, ASM International, Materials Park, OH, 1994, pp. 524-525.

Tamirisakandala et al., "Powder Metallurgy Ti-6Al-4V-xB Alloys: Processing, Microstructure, and Properties". JOM, May 2004, pp. 60-63.

(Continued)

*Primary Examiner* — Lois Zheng

(74) *Attorney, Agent, or Firm* — K & L Gates LLP; Patrick J. Viccaro; John E. Grosselin, III

(57) ABSTRACT

A method of forming an article from an α-β titanium including, in weight percentages, from about 2.9 to about 5.0 aluminum, from about 2.0 to about 3.0 vanadium, from about 0.4 to about 2.0 iron, from about 0.2 to about 0.3 oxygen, from about 0.005 to about 0.3 carbon, from about 0.001 to about 0.02 nitrogen, and less than about 0.5 of other elements. The method comprises cold working the α-β titanium alloy.

22 Claims, No Drawings

(56) References Cited

U.S. PATENT DOCUMENTS

| | | | |
|---|---|---|---|
| 5,277,718 | A | 1/1994 | Paxson et al. |
| 5,332,454 | A | 7/1994 | Meredith et al. |
| 5,332,545 | A | 7/1994 | Love |
| 5,342,458 | A | 8/1994 | Adams et al. |
| 5,358,586 | A | 10/1994 | Schutz |
| 5,442,847 | A | 8/1995 | Semiatin et al. |
| 5,472,526 | A | 12/1995 | Gigliotti, Jr. |
| 5,509,979 | A | 4/1996 | Kimura |
| 5,516,375 | A | 5/1996 | Ogawa et al. |
| 5,520,879 | A | 5/1996 | Saito et al. |
| 5,545,268 | A | 8/1996 | Yashiki et al. |
| 5,558,728 | A | 9/1996 | Kobayashi et al. |
| 5,580,665 | A | 12/1996 | Taguchi et al. |
| 5,679,183 | A | 10/1997 | Takagi et al. |
| 5,698,050 | A | 12/1997 | El-Soudani |
| 5,758,420 | A | 6/1998 | Schmidt et al. |
| 5,759,484 | A | 6/1998 | Kashii et al. |
| 5,795,413 | A | 8/1998 | Gorman |
| 5,871,595 | A | 2/1999 | Ahmed et al. |
| 5,897,830 | A | 4/1999 | Abkowitz et al. |
| 5,954,724 | A | 9/1999 | Davidson |
| 5,980,655 | A | 11/1999 | Kosaka |
| 6,053,993 | A | 4/2000 | Reichman et al. |
| 6,071,360 | A | 6/2000 | Gillespie |
| 6,127,044 | A | 10/2000 | Yamamoto et al. |
| 6,132,526 | A | 10/2000 | Carisey et al. |
| 6,139,659 | A | 10/2000 | Takahashi et al. |
| 6,143,241 | A | 11/2000 | Hajaligol et al. |
| 6,187,045 | B1 | 2/2001 | Fehring et al. |
| 6,200,685 | B1 | 3/2001 | Davidson |
| 6,228,189 | B1 | 5/2001 | Oyama et al. |
| 6,250,812 | B1 | 6/2001 | Ueda et al. |
| 6,258,182 | B1 | 7/2001 | Schetky et al. |
| 6,284,071 | B1 | 9/2001 | Suzuki et al. |
| 6,332,935 | B1 | 12/2001 | Gorman et al. |
| 6,384,388 | B1 | 5/2002 | Anderson et al. |
| 6,387,197 | B1 | 5/2002 | Bewlay et al. |
| 6,391,128 | B2 | 5/2002 | Ueda et al. |
| 6,409,852 | B1 | 6/2002 | Lin et al. |
| 6,536,110 | B2 | 3/2003 | Smith et al. |
| 6,539,607 | B1 | 4/2003 | Fehring et al. |
| 6,539,765 | B2 | 4/2003 | Gates |
| 6,558,273 | B2 | 5/2003 | Kobayashi et al. |
| 6,632,304 | B2 | 10/2003 | Oyama et al. |
| 6,663,501 | B2 | 12/2003 | Chen |
| 6,726,784 | B2 | 4/2004 | Oyama et al. |
| 6,773,520 | B1 | 8/2004 | Fehring et al. |
| 6,800,153 | B2 | 10/2004 | Ishii et al. |
| 7,269,986 | B2 | 9/2007 | Pfaffmann et al. |
| 7,332,043 | B2 | 2/2008 | Tetyukhin et al. |
| 7,410,610 | B2 | 8/2008 | Woodfield et al. |
| 7,438,849 | B2 | 10/2008 | Kuramoto et al. |
| 7,449,075 | B2 | 11/2008 | Woodfield et al. |
| 7,611,592 | B2 | 11/2009 | Davis et al. |
| 7,837,812 | B2 | 11/2010 | Marquardt et al. |
| 7,879,286 | B2 | 2/2011 | Miracle et al. |
| 8,048,240 | B2 | 11/2011 | Hebda et al. |
| 2003/0168138 | A1 | 9/2003 | Marquardt |
| 2004/0099350 | A1 | 5/2004 | Manitone et al. |
| 2004/0221929 | A1 | 11/2004 | Hebda et al. |
| 2004/0250932 | A1 | 12/2004 | Briggs |
| 2007/0017273 | A1 | 1/2007 | Haug et al. |
| 2007/0193662 | A1 | 8/2007 | Jablokov et al. |
| 2007/0286761 | A1 | 12/2007 | Miracle et al. |
| 2008/0210345 | A1 | 9/2008 | Tetyukhin et al. |
| 2008/0264932 | A1 | 10/2008 | Hirota |
| 2009/0183804 | A1 | 7/2009 | Zhao et al. |
| 2010/0307647 | A1 | 12/2010 | Marquardt et al. |
| 2011/0038751 | A1 | 2/2011 | Marquardt et al. |
| 2011/0180188 | A1 | 7/2011 | Bryan et al. |

FOREIGN PATENT DOCUMENTS

| | | | |
|---|---|---|---|
| EP | 0611831 | B2 | 1/1997 |
| EP | 0707085 | B1 | 1/1999 |
| EP | 0683242 | B1 | 5/1999 |
| EP | 1083243 | A2 | 3/2001 |
| EP | 1136582 | A1 | 9/2001 |
| EP | 1302554 | A1 | 4/2003 |
| EP | 1302555 | A1 | 4/2003 |
| EP | 1612289 | A2 | 1/2006 |
| EP | 1882752 | A2 | 1/2008 |
| GB | 847103 | | 9/1960 |
| GB | 2337762 | A | 12/1999 |
| JP | 1-279736 | A | 11/1989 |
| JP | 2-205661 | A | 8/1990 |
| JP | 3-134124 | A | 6/1991 |
| JP | 4-74856 | A | 3/1992 |
| JP | 5-117791 | A | 5/1993 |
| JP | 5-195175 | A | 8/1993 |
| JP | 9-194969 | A | 7/1997 |
| JP | 9-215786 | A | 8/1997 |
| JP | 11-343528 | A | 12/1999 |
| JP | 11-343548 | A | 12/1999 |
| JP | 2000-153372 | A | 6/2000 |
| JP | 2003-55749 | A | 2/2003 |
| JP | 2003-74566 | A | 3/2003 |
| RU | 2172359 | C1 | 8/2001 |
| WO | WO 98/22629 | A | 5/1998 |
| WO | WO 02/090607 | A1 | 11/2002 |
| WO | WO 2008/017257 | A1 | 2/2008 |

OTHER PUBLICATIONS

Tamirisakandala et al., "Effect of boron on the beta transus of Ti-6Al-4V alloy", Scripta Materialia, 53, 2005, pp. 217-222.

Nutt, Michael J. et al., "The Application of Ti-15 Beta Titanium Alloy in High Strength Structural Orthopaedic Applications," Program and Abstracts for The Symposium on Titanium Niobium, Zirconium, and Tantalum for Medical and Surgical Applications, Washington, D.C., Nov. 9-10, 2004 Abstract, p. 12.

Marquardt, Brian, "Ti-15Mo Beta Titanium Alloy Processed for High Strength Orthopaedic Applications," Program and Abstracts for The Symposium on Titanium, Niobium, Zirconium, and Tantalum for Medical and Surgical Applications, Washington, D.C., Nov. 9-10, 2004 Abstract, p. 11.

Marquardt, Brian, "Characterization of Ti-15Mo for Orthopaedic Applications," TMS 2005 Annual Meeting: Technical Program, San Francisco, CA, Feb. 13-17, 2005 Abstract, p. 239.

Imperial Metal Industries Limited, Product Specification for "IMI Titanium 205", The Kynoch Press (England) pp. 1-5. (publication date unknown).

Qazi, J.I. et al., "High-Strength Metastable Beta-Titanium Alloys for Biomedical Applications," JOM, Nov. 2004 pp. 49-51.

Tokaji, Keiro et al., "The Microstructure Dependence of Fatigue Behavior in Ti-15Mo-5Zr-3Al Alloy," Materials Science and Engineering A., vol. 213 (1996) pp. 86-92.

Allegheny Ludlum, "High Performance Metals for Industry, High Strength, High Temperature, and Corrosion-Resistant Alloys", (2000) pp. 1-8.

Disegi, John, Wrought Titanium-15% Molybdenum Implant Material, Original Instruments and Implants of the Association for the Study of International Fixation—AO ASIF, Oct. 2003.

Naik, Uma M. et al., "Omega and Alpha Precipitation in Ti-15Mo Alloy," Titanium '80 Science and Technology—Proceedings of the 4th International Conference on Titanium, H. Kimura & O. Izumi Eds. May 19-22, 1980 pp. 1335-1341.

Pennock, G.M. et al., "The Control of a Precipitation By Two Step Ageing in β Ti-15Mo," Titanium '80 Science and Technology—Proceedings of the 4th International Conference on Titanium. H. Kimura & O. Izumi Eds. May 19-22, 1980 pp. 1344-1350.

Bowen, A. W., "On the Strengthening of a Metastable b-Titanium Alloy by w- and a-Precipitation" Royal Aircraft Establishment Technical Memorandum Mat 338, (1980) pp. 1-15 and Figs 1-5.

Bowen, A. W., "Omega Phase Embrittlement in Aged Ti-15%Mo," Scripta Metallurgica, vol. 5, No. 8 (1971) pp. 709-715.

(56) References Cited

OTHER PUBLICATIONS

"ASTM Designation F2066-01 Standard Specification for Wrought Titanium-15 Molybdenum Alloy for Surgical Implant Applications (UNS R58150)," ASTM International (2000) pp. 1-4.
Disegi, J. A., "Titanium Alloys for Fracture Fixation Implants," Injury International Journal of the Care of the Injured, vol. 31 (2000) pp. S-D14-S-D17.
Ho, W.F. et al., "Structure and Properties of Cast Binary Ti—Mo Alloys" Biomaterials, vol. 20 (1999) pp. 2115-2122.
ASM Materials Engineering Dictionary, J.R. Davis Ed., ASM International, Materials Park, OH (1992) p. 39.
Metals Handbook, Desk Edition, 2nd Ed., J.R. Davis Ed., ASM International, Materials Park, OH (1998) pp. 575-578.
ALLVAC, Product Specification for "Allvac Ti-15 Mo," available at http://www.allvac.com/allvac/pages/Titanium/Ti15MO.htm, last visited Jun. 9, 2003 p. 1 of 1.
Lemons, Jack et al., "Metallic Biomaterials for Surgical Implant Devices," BONEZone, Fall (2002) p. 5-9 and Table.
"ASTM Designation F1801-97 Standard Practice for Corrosion Fatigue Testing of Metallic Implant Materials" ASTM International (1997) pp. 876-880.
Zardiackas, L.D. et al., "Stress Corrosion Cracking Resistance of Titanium Implant Materials," Transactions of the 27th Annual Meeting of the Society for Biomaterials, (2001).
Roach, M.D., et al., "Physical, Metallurgical, and Mechanical Comparison of a Low-Nickel Stainless Steel," Transactions on the 27th Meeting of the Society for Biomaterials, Apr. 24-29, 2001, p. 343.
Roach, M.D., et al., "Stress Corrosion Cracking of a Low-Nickel Stainless Steel," Transactions of the 27th Annual Meeting of the Society for Biomaterials, 2001, p. 469.
ATI Ti-15Mo Beta Titanium Alloy Technical Data Sheet, ATI Allvac, Monroe, NC, Mar. 21, 2008, 3 pages.
Lütjering, G. and J.C. Williams, Titanium, Springer, New York (2nd ed. 2007) p. 24.
Murray, J.L., The Mn—Ti (Manganese-Titanium) System, Bulletin of Alloy Phase Diagrams, vol. 2, No. 3 (1981) p. 334-343.
Semiatin, S.L. et al., "The Thermomechanical Processing of Alpha/Beta Titanium Alloys," Journal of Metals, Jun. 1997, pp. 33-39.
Weiss, I. et al., "Thermomechanical Processing of Beta Titanium Alloys—An Overview," Material Science and Engineering, A243, 1998, pp. 46-65.
Weiss, I. et al., "The Processing Window Concept of Beta Titanium Alloys", Recrystallization '90, ed. by T. Chandra, The Minerals, Metals & Materials Society, 1990, pp. 609-616.
Froes, F.H. et al., "The Processing Window for Grain Size Control in Metastable Beta Titanium Alloys", Beta Titanium Alloys in the 80's, ed. by R. Boyer and H. Rosenberg, AIME, 1984, pp. 161-164.
Myers, J., "Primary Working, A lesson from Titanium and its Alloys," ASM Course Book 27 Lesson, Test 9, Aug. 1994, pp. 3-4.
Metals Handbook, Desk Edition, 2nd ed., J. R. Davis ed., ASM International, Materials Park, Ohio (1998), pp. 575-588.
Tamarisakandala, S. et al., "Strain-induced Porosity During Cogging of Extra-Low Interstitial Grade Ti-6Al-4V", Journal of Materials Engineering and Performance, vol. 10(2), Apr. 2001, pp. 125-130.
Prasad, Y.V.R.K. et al. "Hot Deformation Mechanism in Ti-6Al-4V with Transformed B Starting Microstructure: Commercial v. Extra Low Interstitial Grade", Materials Science and Technology, Sep. 2000, vol. 16, pp. 1029-1036.
Russo, P.A., "Influence of Ni and Fe on the Creep of Beta Annealed Ti-6242S", Titanium '95: Science and Technology, pp. 1075-1082, 1996.
Williams, J., Thermo-mechanical processing of high-performance Ti alloys: recent progress and future needs, Journal of Material Processing Technology, 117 (2001), p. 370-373.
Lutjering, G. and Williams, J.C., Titanium, Springer-Verlag, 2003, Ch. 5: Alpha+Beta Alloys, p. 177-201.
Boyer, Rodney R., "Introduction and Overview of Titanium and Titanium Alloys: Applications," Metals Handbook, ASM Handbooks Online (2002).
Callister, Jr., William D., Materials Science and Engineering, An Introduction, Sixth Edition, John Wiley & Sons, pp. 180-184 (2003).
"Heat Treating of Nonferrous Alloys: Heat Treating of Titanium and Titanium Alloys," Metals Handbook, ASM Handbooks Online (2002).
Hawkins, M.J. et al., "Osseointegration of a New Beta Titanium Alloy as Compared to Standard Orthopaedic Implant Metals," Sixth World Biomaterials Congress Transactions, Society for Biomaterials, 2000, p. 1083.
Jablokov et al., "Influence of Oxygen Content on the Mechanical Properties of Titanium-35Niobium-7Zirconium-5Tantalum Beta Titanium Alloy," Journal of ASTM International, Sep. 2005, vol. 2, No. 8, 2002, pp. 1-12.
Fedotov, S.G. et al., "Effect of Aluminum and Oxygen on the Formation of Metastable Phases in Alloys of Titanium with .beta.-Stabilizing Elements", Izvestiya Akademii Nauk SSSR, Metally (1974) pp. 121-126.
Long, M. et al., "Friction and Surface Behavior of Selected Titanium Alloys During Reciprocating-Sliding Motion", WEAR, 249(1-2), 158-168, 2001.
Takemoto Y et al., "Tensile Behavior and Cold Workability of Ti—Mo Alloys", Materials Transactions Japan Inst. Metals Japan, vol. 45, No. 5, May 2004, pp. 1571-1576.
Lampman, S., "Wrought and Titanium Alloys," ASM Handbooks Online, ASM International, 2002.
Roach, M.D., et al., "Comparison of the Corrosion Fatigue Characteristics of CPTi-Grade 4, Ti-6A1-4V ELI, Ti-6A1-7 Nb, and Ti-15 Mo", Journal of Testing and Evaluation, vol. 2, Issue 7, (Jul./Aug. 2005) (published online Jun. 8, 2005).
Jablokov et al., "The Application of Ti-15 Mo Beta Titanium Alloy in High Strength Orthopaedic Applications", Journal of ASTM International, vol. 2, Issue 8 (Sep. 2005) (published online Jun. 22, 2005).
Marquardt et al., "Beta Titanium Alloy Processed for High Strength Orthopaedic Applications," Journal of ASTM International, vol. 2, Issue 9 (Oct. 2005) (published online Aug. 17, 2008).
SAE Aerospace Material Specification 4897A (issued Jan. 1997, revised Jan. 2003).
"Datasheet: Timetal 21S", Alloy Digest, Advanced Materials and Processes (Sep. 1998), pp. 38-39.
"Stryker Orthopaedics TMZF® Alloy (UNS R58120)", printed from www.allvac.com/allvac/pages/Titanium/UNSR58120.htm on Nov. 7 2005.
ASTM Designation F 2066-01, "Standard Specification for Wrought Titanium-15 Molybdenum Alloy for Surgical Implant Applications (UNS R58150)" 7 pages, 2001.
"Technical Data Sheet: Allvac® Ti-15Mo Beta Titanium Alloy" (dated Jun. 16, 2004).
"Allvac TiOsteum and TiOstalloy Beat Titanium Alloys", printed from www.allvac.com/allvac/pages/Titanium/TiOsteum.htm on Nov. 7, 2005.
Donachie Jr., M.J., "Titanium A Technical Guide" 1988, ASM, pp. 39 and 46-50.
Standard Specification for Wrought Titanium—6Aluminum—4Vanadium Alloy for Surgical Implant Applications (UNS R56400), Designation: F 1472-99, ASTM 1999, pp. 1-4.
Two new α-β titanium alloys, KS Ti-9 for sheet and KS EL-F for forging, with mechanical properties comparable to Ti-6Al-4V, Oct. 8, 2002, ITA 2002 Conference in Orlando, Hideto Oyama, Titanium Technology Dept., Kobe Steel, Ltd., 16 pages.
Harper, Megan Lynn, "A Study of the Microstructural and Phase Evolutions in Timetal 555", Jan. 2001, retrieved from http://www.ohiolink.edu/etd/send-pdf.cgi/harper%20megan%20lynn.pdf?acc_num=osu1132165471 on Aug. 10, 2009, 92 pages.
Nyakana, et al., "Quick Reference Guide for β Titanium Alloys in the 00s", Journal of Materials Engineering and Performance, vol. 14, No. 6, Dec. 1, 2005, pp. 799-811.
Cain, Patrick, "Warm forming aluminum magnesium components; How it can optimize formability, reduce springback", Aug. 1, 2009, from http://www.thefabricator.com/article/presstechnology/warm-forming-aluminum-magnesium-components, 3 pages.
Tebbe, Patrick A. and Ghassan T. Kridli, "Warm forming aluminum alloys: an overview and future directions", Int. J. Materials and Product Technology, vol. 21, Nos. 1-3, 2004, pp. 24-40.

(56) References Cited

OTHER PUBLICATIONS

Duflou et al., "A method for force reduction in heavy duty bending", Int. J. Materials and Product Technology, vol. 32, No. 4, 2008, pp. 460-475.
Imatani et al., "Experiment and simulation for thick-plate bending by high frequency inductor". ACTA Metallurgica Sinica, vol. 11, No. 6, Dec. 1998, pp. 449-455.
Rudnev et at., "Longitudinal flux indication heating of slabs, bars and strips is no longer "Black Magic:"II", Industrial Heating, Feb. 1995, pp. 46-48 and 50-51.
Nguyen et al., "Analysis of bending deformation in triangle heating of steel plates with induction heating process using laminated plate theory", Mechanics Based Design of Structures and Machines, 37, 2009, pp. 228-246.
Lee et al., "An electromagnetic and thermo-mechanical analysis of high frequency induction heating for steel plate bending", Key Engineering Materials, vols. 326-328, 2006, pp. 1283-1286.
Kovtun, et al., "Method of calculating induction heating of steel sheets during thermomechanical bending", Kiev, Nikolaev, translated from Problemy Pròchností, No. 5, pp. 105-110, May 1978, original article submitted Nov. 27, 1977, pp. 600-606.
ATI 425®-MIL Alloy, Technical Data Sheet, Version 1, May 28, 2010, pp. 1-5.
ATI 500-MIL™, Mission Critical Metallics®, High Hard Specialty Steel Armor, Version 4, Sep. 10, 2009, pp. 1-4.
ATI 600-MIL®, Preliminary Draft Data Sheet, Ultra High Hard Specialty Steel Armor, Version 4, Aug. 10, 2010, pp. 1-3.
ATI 600-MIL™, Preliminary Draft Data Sheet, Ultra High Hard Specialty Steel Armor, Version 3, Sep. 10, 2009, pp. 1-3.
ATI Titanium 6Al-2Sn-4Zr-2Mo Alloy, Technical Data Sheet, Version 1, Sep. 17, 2010, pp. 1-3.
ATI Aerospace Materials Development, Mission Critical Metallics, Apr. 30, 2008, 17 pages.
Shahan et al., "Adiabatic shear bands in titanium and titanium alloys: a critical review", Materials & Design, vol. 14, No. 4, 1993, pp. 243-250.
Zhang et al., "Simulation of slip band evolution in duplex Ti-6Al-4V", Acta Materialia, vol. 58, 2010, pp. 1087-1096.
ATI 425®-MIL Titanium Alloy, Mission Critical Metallics®, Version 3, Sep. 10, 2009, pp. 1-4.
ATI Wah Chang, Titanium and Titanium Alloys, Technical Data Sheet. 2003, pp. 1-16.
ATI Wah Chang, ATI™ 425 Titanium Alloy (Ti-4Al-2.5V-1.5Fe-0.2502), Technical Data Sheet, 2004, pp. 1-5.
ATI Titanium 6Al-4V Alloy, Mission Critical Metallics®, Technical Data Sheet, Version 1, Apr. 22, 2010, pp. 1-3.
SAE Aerospace, Aerospace Material Specification, Titanium Alloy Bars, Forgings and Forging Stock, 6.0Al-4.0V, Solution Heat Treated and Aged, AMS 6930A, Issued Jan. 2004, Revised Feb. 2006, pp. 1-9.
SAE Aerospace, Aerospace Material Specification, Titanium Alloy Bars, Forgings and Forging Stock, 6.0Al-4.0V Annealed, AMS 6931A, Issued Jan. 2004, Revised Feb. 2007, pp. 1-7.
SAE Aerospace, Aerospace Material Specification, Titanium Alloy, Sheet, Strip, and Plate, 4Al-2.5V-1.5Fe, Annealed, AMS 6946A, Issued Oct. 2006, Revised Jun. 2007, pp. 1-7.
Military Standard, Fastener Test Methods, Method 13, Double Shear Test, MIL-STD-1312-13, Jul. 26, 1985, superseding MIL-STD-1312 (in part) May 31, 1967, 8 pages.
Military Standard, Fastener Test Methods, Method 13, Double Shear Test, MIL-STD-1312-13A, Aug. 23, 1991, superseding MIL-STD-13, Jul. 26, 1985, 10 pages.
ATI 425®-MIL Alloy, Technical Data Sheet, Version 2, Aug. 16, 2010, 5 pages.
SPS Titanium™ Titanium Fasteners, SPS Technologies Aerospace Fasteners, 2003, 4 pages.
Altemp® A286 Iron-Base Superalloy (UNS Designation S66286) Allegheny Ludlum Technical Data Sheet Blue Sheet, 1998, 8 pages.
Zeng et al., Evaluation of Newly Developed Ti-555 High Strength Titanium Fasteners, 17th AeroMat Conference & Exposition, May 18, 2006, 2 pages.
Office Action mailed Oct. 19, 2011 in U.S. Appl. No. 12/691,952.
Office Action mailed Feb. 20, 2004 in U.S. Appl. No. 10/165,348.
Office Action mailed Oct. 26, 2004 in U.S. Appl. No. 10/165,348.
Office Action mailed Feb. 16, 2005 in U.S. Appl. No. 10/165,348.
Office Action mailed Jul. 25, 2005 in U.S. Appl. No. 10/165,348.
Office Action mailed Jan. 3, 2006 in U.S. Appl. No. 10/165,348.
Office Action mailed Dec. 16, 2004 in U.S. Appl. No. 10/434,598.
Office Action mailed Aug. 17, 2005 in U.S. Appl. No. 10/434,598.
Office Action mailed Dec. 19, 2005 in U.S. Appl. No. 10/434,598.
Office Action mailed Aug. 6, 2008 in U.S. Appl. No. 11/448,160.
Office Action mailed Jan. 13, 2009 in U.S. Appl. No. 11/448,160.
Notice of Allowance mailed Apr. 13, 2010 in U.S. Appl. No. 11/448,160.
Notice of Allowance mailed Sep. 20, 2010 in U.S. Appl. No. 11/448,160.
Office Action mailed Sep. 26, 2007 in U.S. Appl. No. 11/057,614.
Office Action mailed Jan. 10, 2008 in U.S. Appl. No. 11/057,614.
Office Action mailed Aug. 29, 2008 in U.S. Appl. No. 11/057,614.
Office Action mailed Aug. 11, 2009 in U.S. Appl. No. 11/057,614.
Office Action mailed Jan. 14, 2010 in U.S. Appl. No. 11/057,614.
Interview summary mailed Apr. 14, 2010 in U.S. Appl. No. 11/057,614.
Office Action mailed Jun. 21, 2010 in U.S. Appl. No. 11/057,614.
Notice of Allowance mailed Sep. 3, 2010 in U.S. Appl. No. 11/057,614.
Office Action mailed Apr. 1, 2010 in U.S. Appl. No. 11/745,189.
Interview summary mailed Jun. 3, 2010 in U.S. Appl. No. 11/745,189.
Interview summary mailed Jun. 15, 2010 in U.S. Appl. No. 11/745,189.
Office Action mailed Nov. 24, 2010 in U.S. Appl. No. 11/745,189.
Interview summary mailed Jan. 6, 2011 in U.S. Appl. No. 11/745,189.
Notice of Allowance mailed Jun. 27, 2011 in U.S. Appl. No. 11/745,189.
Office Action mailed Jan. 11, 2011 in U.S. Appl. No. 12/911,947.
Office Action mailed Aug. 4, 2011 in U.S. Appl. No. 12/911,947.
Office Action mailed Jul. 27, 2011 in U.S. Appl. No. 12/857,789.
Advisory Action mailed Oct. 7, 2011 in U.S. Appl. No. 12/857,789.
U.S. Appl. No. 12/845,122, filed Jul. 28, 2010.
U.S. Appl. No. 12/838,674, filed Jul. 19, 2010.
U.S. Appl. No. 12/885,620, filed Sep. 20, 2010.
U.S. Appl. No. 13/230,046, filed Sep. 12, 2011.

PROCESSING OF TITANIUM-ALUMINUM-VANADIUM ALLOYS AND PRODUCTS MADE THEREBY

CROSS-REFERENCE TO RELATED APPLICATIONS

This application is a continuation application and claims the benefit of the filing date of co-pending U.S. patent application Ser. No. 11/745,189, filed on May 7, 2007, which is a continuation application of U.S. patent application Ser. No. 10/434,598, filed on May 9, 2003, now abandoned.

TECHNICAL FIELD

The present invention relates to novel methods of processing certain titanium alloys comprising aluminum, vanadium, iron, and oxygen, to articles made using such processing methods, and to novel articles including such alloys.

BACKGROUND

Beginning at least as early as the 1950's, titanium was recognized to have properties making it attractive for use as structural armor against small arms projectiles. Investigation of titanium alloys for the same purpose followed. One titanium alloy known for use as ballistic armor is the Ti-6Al-4V alloy, which nominally comprises titanium, 6 weight percent aluminum, 4 weight percent vanadium and, typically, less than 0.20 weight percent oxygen. Another titanium alloy used in ballistic armor applications includes 6.0 weight percent aluminum, 2.0 weight percent iron, a relatively low oxygen content of 0.18 weight percent, less than 0.1 weight percent vanadium, and possibly other trace elements. Yet another titanium alloy that has been shown suitable for ballistic armor applications is the alpha-beta ($\alpha$-$\beta$) titanium alloy of U.S. Pat. No. 5,980,655, issued Nov. 9, 1999 to Kosaka. In addition to titanium, the alloy claimed in the '655 patent, which is referred to herein as the "Kosaka alloy", includes, in weight percentages, about 2.9 to about 5.0 aluminum, about 2.0 to about 3.0 vanadium, about 0.4 to about 2.0 iron, greater than 0.2 to about 0.3 oxygen, about 0.005 to about 0.03 carbon, about 0.001 to about 0.02 nitrogen, and less than about 0.5 of other elements.

Armor plates formed from the above titanium alloys have been shown to satisfy certain V50 standards established by the military to denote ballistic performance. These standards include those in, for example, MIL-DTL-96077F, "Detail Specification, Armor Plate, Titanium Alloy, Weldable". The V50 is the average velocity of a specified projectile type that is required to penetrate an alloy plate having specified dimensions and positioned relative to the projectile firing point in a specified manner.

The above titanium alloys have been used to produce ballistic armor because when evaluated against many projectile types the titanium alloys provide better ballistic performance using less mass than steel or aluminum. Despite the fact that certain titanium alloys are more "mass efficient" than steel and aluminum against certain ballistic threats, there is a significant advantage to further improving the ballistic performance of known titanium alloys. Moreover, the process for producing ballistic armor plate from the above titanium alloys can be involved and expensive. For example, the '655 patent describes a method wherein a Kosaka alloy that has been thermomechanically processed by multiple forging steps to a mixed $\alpha$-$\beta$ microstructure is hot rolled and annealed to produce ballistic armor plate of a desired gauge. The surface of the hot rolled plate develops scale and oxides at the high processing temperatures, and must be conditioned by one or more surface treatment steps such as grinding, machining, shotblasting, pickling, etc. This complicates the fabrication process, results in yield losses, and increases the cost of the finished ballistic plate.

Given the advantageous strength-to-weight properties of certain titanium alloys used in ballistic armor applications, it would be desirable to fabricate articles other than ballistic plate from these alloys. However, it is generally believed that it is not possible to readily apply fabrication techniques other than simple hot rolling to many of these high-strength titanium alloys. For example, Ti-6Al-4V in plate form is considered too high in strength for cold rolling. Thus, the alloy is typically produced in sheet form via a complicated "pack rolling" process wherein two or more plates of Ti-6Al-4V having an intermediate thickness are stacked and enclosed in a steel can. The can and its contents are hot rolled, and the individual plates are then removed and ground, pickled and trimmed. The process is expensive and may have a low yield given the necessity to grind and pickle the surfaces of the individual sheets. Similarly, it is conventionally believed that the Kosaka alloy has relatively high resistance to flow at temperatures below the $\alpha$-$\beta$ rolling temperature range. Thus, it is not known to form articles other than ballistic plate from the Kosaka alloy, and it is only known to form such plate using the hot rolling technique generally described in the '655 patent. Hot rolling is suited to production of only relatively rudimentary product forms, and also requires relatively high energy input.

Considering the foregoing description of conventional methods of processing certain titanium alloys known for use in ballistic armor applications, there is a need for a method of processing such alloys to desired forms, including forms other than plate, without the expense, complexity, yield loss and energy input requirements of the known high temperature working processes.

SUMMARY

In order to address the above-described needs, the present disclosure provides novel methods for processing the $\alpha$-$\beta$ titanium-aluminum-vanadium-alloy described and claimed in the '655 patent, and also describes novel articles including the $\alpha$-$\beta$ titanium alloy.

One aspect of the present disclosure is directed to a method of forming an article from an $\alpha$-$\beta$ titanium alloy comprising, in weight percentages, from about 2.9 to about 5.0 aluminum, from about 2.0 to about 3.0 vanadium, from about 0.4 to about 2.0 iron, from about 0.2 to about 0.3 oxygen, from about 0.005 to about 0.3 carbon, from about 0.001 to about 0.02 nitrogen, and less than about 0.5 of other elements. The method comprises cold working the $\alpha$-$\beta$ titanium alloy. In certain embodiments, the cold working may be conducted with the alloy at a temperature in the range of ambient temperature up to less than about 1250° F. (about 677° C.). In certain other embodiments, the $\alpha$-$\beta$ alloy is cold worked while at a temperature ranging from ambient temperature up to about 1000° F. (about 538° C.). Prior to cold working, the $\alpha$-$\beta$ titanium alloy may optionally be worked at a temperature greater than about 1600° F. (about 871° C.) to provide the alloy with a microstructure that is conducive to cold deformation during the cold working.

The present disclosure also is directed to articles made by the novel methods described herein. In certain embodiments, an article formed by an embodiment of such methods has a thickness up to 4 inches and exhibits room temperature properties including tensile strength of at least 120 KSI and ultimate tensile strength of at least 130 KSI. Also, in certain embodiments an article formed by an embodiment of such methods exhibits elongation of at least 10%.

The inventors have determined that any suitable cold working technique may be adapted for use with the Kosaka alloy. In certain non-limiting embodiments, one or more cold rolling steps are used to reduce a thickness of the alloy. Examples of articles that may be made by such embodiments include a sheet, a strip, a foil and a plate. In the case where at least two cold rolling steps are used, the method also may include annealing the alloy intermediate to successive cold rolling steps so as to reduce stresses within the alloy. In certain of these embodiments, at least one stress-relief anneal intermediate successive cold rolling steps may be conducted on a continuous anneal furnace line.

Also disclosed herein is a novel method for making armor plate from an α-β titanium alloy including, in weight percentages, from about 2.9 to about 5.0 aluminum, from about 2.0 to about 3.0 vanadium, from about 0.4 to about 2.0 iron, from about 0.2 to about 0.3 oxygen, from about 0.005 to about 0.3 carbon, from about 0.001 to about 0.02 nitrogen, and less than about 0.5 of other elements. The method comprises rolling the alloy at temperatures significantly less than temperatures conventionally used to hot roll the alloy to produce armor plate. In one embodiment of the method, the alloy is rolled at a temperature that is no greater than 400° F. (about 222° C.) below the $T_\beta$ of the alloy.

An additional aspect of the present invention is directed to a cold worked article of an α-β titanium alloy, wherein the alloy includes, in weight percentages, from about 2.9 to about 5.0 aluminum, from about 2.0 to about 3.0 vanadium, from about 0.4 to about 2.0 iron, from about 0.2 to about 0.3 oxygen, from about 0.005 to about 0.3 carbon, from about 0.001 to about 0.02 nitrogen, and less than about 0.5 of other elements. Non-limiting examples of the cold worked article include an article selected from a sheet, a strip, a foil, a plate, a bar, a rod, a wire, a tubular hollow, a pipe, a tube, a cloth, a mesh, a structural member, a cone, a cylinder, a duct, a pipe, a nozzle, a honeycomb structure, a fastener, a rivet and a washer. Certain of the cold worked articles may have thickness in excess of one inch in cross-section and room temperature properties including tensile strength of at least 120 KSI and ultimate tensile strength of at least 130 KSI. Certain of the cold worked articles may have elongation of at least 10%.

Certain methods described in the present disclosure incorporate the use of cold working techniques, which were not heretofore believed suitable for processing the Kosaka alloy. In particular, it was conventionally believed that the Kosaka alloy's resistance to flow at temperatures significantly below the α-β hot rolling temperature range was too great to allow the alloy to be worked successfully at such temperatures. With the present inventors' unexpected discovery that the Kosaka alloy may be worked by conventional cold working techniques at temperatures less than about 1250° F. (about 677° C.), it becomes possible to produce myriad product forms that are not possible through hot rolling and/or are significantly more expensive to produce using hot working techniques. Certain methods described herein are significantly less involved than, for example, the conventional pack rolling technique described above for producing sheet from Ti-6Al-4V. Also, certain methods described herein do not involve the extent of yield losses and the high energy input requirements inherent in processes involving high temperature working to finished gauge and/or shape. Yet an additional advantage is that certain of the mechanical properties of embodiments of the Kosaka alloy approximate or exceed those of Ti-6Al-4V, which allows for the production of articles not previously available from Ti-6Al-4V, yet which have similar properties.

These and other advantages will be apparent upon consideration of the following description of embodiments of the invention.

DESCRIPTION

As noted above, U.S. Pat. No. 5,980,655, issued to Kosaka, describes an alpha-beta (α-β) titanium alloy and the use of that alloy as ballistic armor plate. The '655 patent is hereby incorporated herein in its entirety by reference. In addition to titanium, the alloy described and claimed in the '655 patent comprises the alloying elements in Table 1 below. For ease of reference, the titanium alloy including the alloying element additions in Table 1 is referred to herein as the "Kosaka alloy".

TABLE 1

| Alloying Element | Percent by Weight |
|---|---|
| Aluminum | from about 2.9 to about 5.0 |
| Vanadium | from about 2.0 to about 3.0 |
| Iron | from about 0.4 to about 2.0 |
| Oxygen | greater than 0.2 to about 0.3 |
| Carbon | from about 0.005 to about 0.03 |
| Nitrogen | from about 0.001 to about 0.02 |
| Other elements | less than about 0.5 |

As described in the '655 patent, the Kosaka alloy optionally may include elements other than those specifically listed in Table 1. Such other elements, and their percentages by weight, may include, but are not necessarily limited to, one or more of the following: (a) chromium, 0.1% maximum, generally from about 0.0001% to about 0.05%, and preferably up to about 0.03%; (b) nickel, 0.1% maximum, generally from about 0.001% to about 0.05%, and preferably up to about 0.02%; (c) carbon, 0.1% maximum, generally from about 0.005% to about 0.03%, and preferably up to about 0.01%; and (d) nitrogen, 0.1% maximum, generally from about 0.001% to about 0.02%, and preferably up to about 0.01%.

One particular commercial embodiment of the Kosaka alloy is available from Wah Chang, an Allegheny Technologies Incorporated company, having the nominal composition, 4 weight percent aluminum, 2.5 weight percent vanadium, 1.5 weight percent iron, and 0.25 weight percent oxygen. Such nominal composition is referred to herein as "Ti-4Al-2.5V-1.5Fe-0.25$O_2$".

The '655 patent explains that the Kosaka alloy is processed in a manner consistent with conventional thermomechanical processing ("TMP") used with certain other α-β titanium alloys. In particular, the '655 patent notes that the Kosaka alloy is subjected to wrought deformation at elevated temperatures above the beta transus temperature ($T_\beta$) (which is approximately 1800° F. (about 982° C.) for Ti-4Al-2.5V-1.5Fe-0.25$O_2$), and is subsequently subjected to additional wrought thermomechanical processing below $T_\beta$. This processing allows for the possibility of beta (i.e., temperature>$T_\beta$) recrystallization intermediate the α-β thermomechanical processing cycle.

The '655 patent is particularly directed to producing ballistic armor plate from the Kosaka alloy in a way to provide a product including a mixed α-β microstructure. The α-β processing steps described in the patent are generally as follows: (1) β forge the ingot above $T_\beta$ to form an intermediate slab; (2) α-β forge the intermediate slab at a temperature below $T_\beta$; (3)

α-β roll the slab to form a plate; and (4) anneal the plate. The '655 patent teaches that the step of heating the ingot to a temperature greater than $T_\beta$ may include, for example, heating the ingot to a temperature of from about 1900° F. to about 2300° F. (about 1038° C. to about 1260° C.). The subsequent step of α-β forging the intermediate gauge slab at a temperature below $T_\beta$ may include, for example, forging the slab at a temperature in the α-β temperature range. The patent more particularly describes α-β forging the slab at a temperature in the range of from about 50° F. to about 200° F. (about 28° C. to about 111° C.) below $T_\beta$, such as from about 1550° F. to about 1775° F. (about 843° C. to about 968° C.). The slab is then hot rolled in a similar α-β temperature range, such as from about 1550° F. to about 1775° F. (about 843° C. to about 968° C.), to form a plate of a desired thickness and having favorable ballistic properties. The '655 patent describes the subsequent annealing step following the α-β rolling step as occurring at about 1300° F. to about 1500° F. (about 704° C. to about 816° C.). In the examples specifically described in the '655 patent, plates of the Kosaka alloy were formed by subjecting the alloy to β and α-β forging, α-β hot rolling at 1600° F. (about 871° C.) or 1700° F. (about 927° C.), and then "mill" annealing at about 1450° F. (about 788° C.). Accordingly, the '655 patent teaches producing ballistic plate from the Kosaka alloy by a process including hot rolling the alloy within the α-β temperature range to the desired thickness.

In the course of producing ballistic armor plate from the Kosaka alloy according to the processing method described in the '655 patent, the present inventors unexpectedly and surprisingly discovered that forging and rolling conducted at temperatures below $T_\beta$ resulted in significantly less cracking, and that mill loads experienced during rolling at such temperatures were substantially less than for equivalently sized slabs of Ti-6Al-4V alloy. In other words, the present inventors unexpectedly observed that the Kosaka alloy exhibited a decreased resistance to flow at elevated temperatures. Without intending to be limited to any particular theory of operation, it is believed that this effect, at least in part, is attributable to a reduction in strengthening of the material at elevated temperatures due to the iron and oxygen content in the Kosaka alloy. This effect is illustrated in the following Table 2, which provides mechanical properties measured for a sample of the Ti-4Al-2.5V-1.5Fe-0.25$O_2$ alloy at various elevated temperatures.

TABLE 2

| Temperature (° F.) | Yield Strength (KSI) | Ultimate Tensile Strength (KSI) | Elongation (%) |
|---|---|---|---|
| 800 | 63.9 | 85.4 | 22 |
| 1000 | 46.8 | 67.0 | 32 |
| 1200 | 17.6 | 34.4 | 62 |
| 1400 | 6.2 | 16.1 | 130 |
| 1500 | 3.1 | 10.0 | 140 |

Although the Kosaka alloy was observed to have reduced flow resistance at elevated temperatures during the course of producing ballistic plate from the material, the final mechanical properties of the annealed plate were observed to be in the general range of similar plate product produced from Ti-6Al-4V. For example, the following Table 3 provides mechanical properties of 26 hot rolled ballistic armor plates prepared from two 8,000 lb. ingots of Ti-4Al-2.5V-1.5Fe-0.25$O_2$ alloy. The results of Table 3 and other observations by the inventors indicate that products less than, for example, about 2.5 inches in cross-sectional thickness formed from Kosaka alloy by the processes disclosed herein may have 120 KSI minimum yield strength, minimum 130 KSI ultimate tensile strength, and minimum 12% elongation. However, it is possible that articles with these mechanical properties and much larger cross-section, such as less than 4 inches, might be produced through cold working on certain large-scale bar mills. These properties compare favorably with those of Ti-6Al-4V. For example, Materials Properties Handbook, Titanium Alloys (ASM International, 2d printing, January 1998) page 526, reports room temperature tensile properties of 127 KSI yield strength, 138 KSI ultimate tensile strength, and 12.7% elongation for Ti-6Al-4V cross-rolled at 955° C. (about 1777° F.) and mill annealed. The same text, at page 524, lists typical Ti-6Al-4V tensile properties of 134 KSI yield strength, 144 KSI ultimate tensile strength, and 14% elongation. Although tensile properties are influenced by product form, cross section, measurement direction, and heat treatment, the foregoing reported properties for Ti-6Al-4V provide a basis for generally evaluating the relative tensile properties of the Kosaka alloy.

TABLE 3

| Tensile Properties | |
|---|---|
| Longitudinal | |
| Yield Strength | 120.1-130.7 KSI |
| Ultimate Tensile Strength | 133.7-143.1 KSI |
| Elongation | 13%-19% |
| Transverse | |
| Yield Strength | 122.6-144.9 KSI |
| Ultimate Tensile Strength | 134.0-155.4 KSI |
| Elongation | 15%-20% |

The present inventors also have observed that cold rolled Ti-4Al-2.5V-1.5Fe-0.25$O_2$ generally exhibits somewhat better ductility than Ti-6Al-4V material. For example, in one test sequence, described below, twice cold rolled and annealed Ti-4Al-2.5V-1.5Fe-0.25$O_2$ material survived 2.5 T bend radius bending in both longitudinal and transverse directions.

Thus, the observed reduced resistance to flow at elevated temperatures presents an opportunity to fabricate articles from the Kosaka alloy using working and forming techniques not previously considered suitable for use with either the Kosaka alloy or Ti-6Al-4V, while achieving mechanical properties typically associated with Ti-6Al-4V. For example, the work described below shows that Kosaka alloy can be readily extruded at elevated temperatures generally considered "moderate" in the titanium processing industry, which is a processing technique that is not suggested in the '655 patent. Given the results of the elevated temperature extrusion experiments, other elevated temperature forming methods which it is believed may be used to process Kosaka alloy include, but are not limited to, elevated temperature closed die forging, drawing, and spinning. An additional possibility is rolling at moderate temperature or other elevated temperatures to provide relatively light gauge plate or sheet, and thin gauge strip. These processing possibilities extend substantially beyond the hot rolling technique described in the '655 patent to produce hot rolled plate, and make possible product forms which are not readily capable of being produced from Ti-6Al-4V, but which nevertheless would have mechanical properties similar to Ti-6Al-4V.

The present inventors also unexpectedly and surprisingly discovered that the Kosaka alloy has a substantial degree of cold formability. For example, trials of cold rolling of coupons of Ti-4Al-2.5V-1.5Fe-0.25$O_2$ alloy, described below, yielded thickness reductions of approximately 37% before edge cracking first appeared. The coupons were initially produced by a process similar to the conventional armor plate process and where of a somewhat coarse microstructure. Refining of the microstructure of the coupons through increased α-β working and selective stress relief annealing allowed for cold reductions of up to 44% before stress-relief annealing was required to permit further cold reduction. During the course of the inventors' work, it also was discovered that the Kosaka alloy could be cold worked to much higher strengths and still retain some degree of ductility. This previously unobserved phenomenon makes possible the production of a cold rolled product in coil lengths from the Kosaka alloy, but with mechanical properties of Ti-6Al-4V.

The cold formability of Kosaka alloy, which includes relatively high oxygen levels, is counter-intuitive. For example, Grade 4 CP (Commercially Pure) titanium, which includes a relatively high level of about 0.4 weight percent oxygen, shows a minimum elongation of about 15% and is known for being less formable than other CP grades. With the exception of certain CP titanium grades, the single cold workable α-β titanium alloy produced in significant commercial volume is Ti-3Al-2.5V (nominally, in weight percent, 3 aluminum, 2.5 vanadium, max. 0.25 iron, max. 0.05 carbon, and max. 0.02 nitrogen). The inventors have observed that embodiments of the Kosaka alloy are as cold formable as Ti-3Al-2.5V but also exhibit more favorable mechanical properties. The only commercially significant non-α-β titanium alloy that is readily cold formable is Ti-15V-3Al-3Cr-3Sn, which was developed as a cold rollable alternative to Ti-6Al-4V sheet. Although Ti-15V-3Al-3Cr-3Sn has been produced as tube, strip, plate and other forms, it has remained a specialty product that does not approach the production volume of Ti-6Al-4V. The Kosaka alloy may be significantly less expensive to melt and fabricate than specialty titanium alloys such as Ti-15V-3Al-3Cr-3Sn.

Given the cold workability of Kosaka alloy and the inventors' observations when applying cold working techniques to the alloy, some of which are provided below, it is believed that numerous cold working techniques previously believed unsuited for the Kosaka alloy may be used to form articles from the alloy. In general, "cold working" refers to working an alloy at a temperature below that at which the flow stress of the material is significantly diminished. As used herein in connection with the present invention, "cold working", "cold worked", "cold forming" or like terms, or "cold" used in connection with a particular working or forming technique, refer to working or the characteristic of having been worked, as the case may be, at a temperature no greater than about 1250° F. (about 677° C.). Preferably, such working occurs at no greater than about 1000° F. (about 538° C.). Thus, for example, a rolling step conducted on a Kosaka alloy plate at 950° F. (510° C.) is considered herein to be cold working. Also, the terms "working" and "forming" are generally used interchangeably herein, as are the terms "workability" and "formability" and like terms.

Cold working techniques that may be used with the Kosaka alloy include, for example, cold rolling, cold drawing, cold extrusion, cold forging, rocking/pilgering, cold swaging, spinning, and flow-turning. As is known in the art, cold rolling generally consists of passing previously hot rolled articles, such as bars, sheets, plates, or strip, through a set of rolls, often several times, until a desired gauge is obtained. Depending upon the starting structure after hot (α-β) rolling and annealing, it is believed that at least a 35-40% reduction in area (RA) could be achieved by cold rolling a Kosaka alloy before any annealing is required prior to further cold rolling. Subsequent cold reductions of at least 30-60% are believed possible, depending upon product width and mill configuration.

The ability to produce thin gauge coil and sheet from Kosaka alloy is a substantial improvement. The Kosaka alloy has properties similar to, and in some ways improved relative to, properties of Ti-6Al-4V. In particular, investigations conducted by the inventors indicate that the Kosaka alloy has improved ductility relative to Ti-6Al-4V as evidenced by elongation and bend properties. Ti-6Al-4V has been the main titanium alloy in use for well over 30 years. However, as noted above, sheet is conventionally produced from Ti-6Al-4V, and from many other titanium alloys, by involved and expensive processing. Because the strength of Ti-6Al-4V is too high for cold rolling and the material preferentially texture strengthens, resulting in transverse properties with virtually no ductility, Ti-6Al-4V sheet is commonly produced as single sheets via pack rolling. Single sheets of Ti-6Al-4V would require more mill force than most rolling mills can produce, and the material must still be rolled hot. Single sheets lose heat rapidly and would require reheating after each pass. Thus, the intermediate gauge Ti-6Al-4V sheets/plates are stacked two or more high and enclosed in a steel can, which is rolled in its entirety. However, because the industry mode for canning does not utilize vacuum sealing, after hot rolling each sheet must be belt ground and sanded to remove the brittle oxide layer, which severely inhibits ductile fabrication. The grinding process introduces strike marks from the grit, which act as crack initiation sites for this notch sensitive material. Therefore, the sheets also must be pickled to remove the strike marks. Furthermore, each sheet is trimmed on all sides, with 2-4 inches of trim typically left on one end for gripping while the sheet is ground in a pinch-roll grinder. Typically, at least about 0.003 inch per surface is ground away, and at least about 0.001 inch per surface is pickled away, resulting in a loss that is typically at least about 0.008 inch per sheet. For sheet of 0.025-inch final thickness, for example, the rolled-to-size sheet must be 0.033 inch, for a loss of about 24% through grinding and pickling, irrespective of trim losses. The cost of steel for the can, the cost of grinding belts, and the labor costs associated with handling individual sheets after pack rolling causes sheets having thickness of 0.040 inch or less to be quite expensive. Accordingly, it will be understood that the ability to provide a cold rolled α-β titanium alloy in a continuous coil form (Ti-6Al-4V is typically produced in standard sheet sizes of 36×96 inches and 48×120 inches) having mechanical properties similar to or better than Ti-6Al-4V is a substantial improvement.

Based on the inventors' observations, cold rolling of bar, rod, and wire on a variety of bar-type mills, including Koch's-type mills, also may be accomplished on the Kosaka alloy. Additional examples of cold working techniques that may be used to form articles from Kosaka alloy include pilgering (rocking) of extruded tubular hollows for the manufacture of seamless pipe, tube and ducting. Based on the observed properties of the Kosaka alloy, it is believed that a larger reduction in area (RA) may be achieved in compressive type forming than with flat rolling. Drawing of rod, wire, bar and tubular hollows also may be accomplished. A particularly attractive application of the Kosaka alloy is drawing or pilgering to tubular hollows for production of seamless tubing, which is particularly difficult to achieve with Ti-6Al-4V alloy. Flow turning (also referred to in the art as shear-spinning) may be accomplished using the Kosaka alloy to produce axially symmetric hollow forms including cones, cylinders, aircraft ducting, nozzles, and other "flow-directing"-type components. A variety of liquid or gas-type compressive, expansive type forming operations such as hydro-forming or bulge forming may be used. Roll forming of continuous-type stock may be accomplished to form structural variations of "angle iron" or "uni-strut" generic structural members. In addition, based on the inventors' findings, operations typically associated with sheet metal processing, such as stamping, fine-blanking, die pressing, deep drawing, coining may be applied to the Kosaka alloy.

In addition to the above cold forming techniques, it is believed that other "cold" techniques that may be used to form articles from the Kosaka alloy include, but are not necessarily limited to, forging, extruding, flow-turning, hydro-forming, bulge forming, roll forming, swaging, impact extruding, explosive forming, rubber forming, back extrusion, piercing, spinning, stretch forming, press bending, electromagnetic forming, and cold heading. Those having ordinary skill, upon considering the inventors' observations and conclusions and other details provided in the present description of the invention, may readily comprehend additional cold working/forming techniques that may be applied to the Kosaka alloy. Also, those having ordinary skill may readily apply such techniques to the alloy without undue experimentation. Accordingly, only certain examples of cold working of the alloy are described herein. The application of such cold working and forming techniques may provide a variety of articles. Such articles include, but are not necessarily limited to the following: a sheet, a strip, a foil, a plate, a bar, a rod, a wire, a tubular hollow, a pipe, a tube, a cloth, a mesh, a structural member, a cone, a cylinder, a duct, a pipe, a nozzle, a honeycomb structure, a fastener, a rivet and a washer.

The combination of unexpectedly low flow resistance of Kosaka alloy at elevated working temperatures combined with the unexpected ability to subsequently cold work the alloy should permit a lower cost product form in many cases than using conventional Ti-6Al-4V alloy to produce the same products. For example, it is believed that an embodiment of Kosaka alloy having the nominal composition Ti-4Al-2.5V-1.5Fe-0.25$O_2$ can be produced in certain product forms in greater yields than Ti-6Al-4V alloy because less surface and edge checking is experienced with the Kosaka alloy during typical $\alpha$-$\beta$ processing of the two alloys. Thus, it has been the case that Ti-4Al-2.5V-1.5Fe-0.25$O_2$ requires less surface grinding and other surface conditioning that can result in loss of material. It is believed that in many cases the yield differential would be demonstrated to an even greater degree when producing finished products from the two alloys. In addition, the unexpectedly low flow resistance of the Kosaka alloy at $\alpha$-$\beta$ hot working temperatures would require less frequent re-heating and create less stress on tooling, both of which should further reduce processing costs. Moreover, when these attributes of the Kosaka alloy are combined with its unexpected degree of cold workability, a substantial cost advantage may be available relative to Ti-4Al-6V given the conventional requirement to hot pack roll and grind Ti-6Al-4V sheet. The combined low resistance to flow at elevated temperature and cold workability should make the Kosaka alloy particularly amenable to being processed into the form of a coil using processing techniques similar to those used in the production of coil from stainless steel.

The unexpected cold workability of the Kosaka alloy results in finer surface finishes and a reduced need for surface conditioning to remove the heavy surface scale and diffused oxide layer that typically results on the surface of a Ti-6Al-4V pack rolled sheet. Given the level of cold workability the present inventors have observed, it is believed that foil thickness product in coil lengths may be produced from the Kosaka alloy with properties similar to those of Ti-6Al-4V.

Examples of the inventors' various methods of processing the Kosaka alloy follow.

EXAMPLES

Unless otherwise indicated, all numbers expressing quantities of ingredients, composition, time, temperatures, and so forth in the present disclosure are to be understood as being modified in all instances by the term "about." Accordingly, unless indicated to the contrary, the numerical parameters set forth in the specification and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, may inherently contain certain errors necessarily resulting from the standard deviation found in their respective testing measurements.

Example 1

Seamless pipe was prepared by extruding tubular hollows from a heat of the Kosaka alloy having the nominal composition Ti-4Al-2.5V-1.5Fe-0.25$O_2$. The actual measured chemistry of the alloy is shown in Table 4 below:

TABLE 4

| Alloying Element | Percent by Weight |
|---|---|
| Aluminum | 4.02-4.14 wt. % |
| Vanadium | 2.40-2.43 wt. % |
| Iron | 1.50-1.55 wt. % |
| Oxygen | 2300-2400 ppm |
| Carbon | 246-258 ppm |
| Nitrogen | 95-110 ppm |
| Silicon | 200-210 ppm |
| Chromium | 210-240 ppm |
| molybdenum | 120-190 ppm |

The alloy was forged at 1700° F. (about 927° C.), and then rotary forged at about 1600° F. (about 871° C.). The calculated $T_\beta$ of the alloy was approximately 1790° F. (about 977° C.). Two billets of the hot forged alloy, each having a 6 inch outer diameter and 2.25 inch inner diameter, were extruded to tubular hollows having 3.1 inch outer diameter and 2.2 inch inner diameter. The first billet (billet #1) was extruded at about 788° C. (about 1476° F.) and yielded about 4 feet of material satisfactory for rocking to form seamless pipe. The second billet (billet #2) was extruded at about 843° C. (about 1575° F.) and produced a satisfactory extruded tubular hollow along its entire length. In each case, the shape, dimensions and surface finish of the extruded material indicated that the material could be successfully cold worked by pilgering or rocking after annealing and conditioning.

A study was conducted to determine tensile properties of the extruded material after being subjected to various heat treatments. Results of the study are provided in Table 5 below. The first two rows of Table 5 list properties measured for the extrusions in their "as extruded" form. The remaining rows relate to samples from each extrusion that were subjected to additional heat treatment and, in some cases, a water quench ("WQ") or air cool ("AC"). The last four rows successively list the temperature of each heat treatment step employed.

TABLE 5

| Processing | Temp. | Yield Strength (KSI) | Ultimate Tensile Strength (KSI) | Elongation (%) |
|---|---|---|---|---|
| As Extruded (billet #1) | N/A | 131.7 | 148.6 | 16 |
| As Extruded (billet #2) | N/A | 137.2 | 149.6 | 18 |
| Anneal 4 hrs. (#1) | 1350° F./732° C. | 126.7 | 139.2 | 18 |
| Anneal 4 hrs. (#2) | 1350° F./732° C. | 124.4 | 137.9 | 18 |
| Anneal 4 hrs. (#1) | 1400° F./760° C. | 125.4 | 138.9 | 19 |
| Anneal 4 hrs. (#2) | 1400° F./760° C. | 124.9 | 139.2 | 19 |
| Anneal 1 hr. (#1) | 1400° F./760° C. | 124.4 | 138.6 | 18 |
| Anneal 1 hr. (#2) | 1400° F./760° C. | 127.0 | 139.8 | 18 |
| Anneal 4 hrs. (#1) | 1450° F./788° C. | 127.7 | 140.5 | 18 |
| Anneal 4 hrs. (#2) | 1450° F./788° C. | 125.3 | 139.0 | 19 |
| Anneal 1 hr. + WQ (#1) | 1700° F./927° C. | N/A | 187.4 | 12 |
| Anneal 1 hr. + WQ (#2) | 1700° F./927° C. | 162.2 | 188.5 | 15 |
| Anneal 1 hr. + WQ + 8 hrs. + AC (#1) | 1700° F./927° C. 1000° F./538° C. | 157.4 | 175.5 | 13 |
| Anneal 1 hr. + WQ + 8 hrs. + AC (#2) | 1700° F./927° C. 1000° F./538° C. | 159.5 | 177.9 | 9 |
| Anneal 1 hr. + WQ + 1 hr. + AC (#1) | 1700° F./927° C. 1400° F./760° C. | 133.8 | 147.5 | 19 |
| Anneal 1 hr. + WQ + 1 hr. + AC (#2) | 1700° F./927° C. 1400° F./760° C. | 132.4 | 146.1 | 18 |

The results in Table 5 show strengths comparable to hot-rolled and annealed plate as well as precursor flat stock which was subsequently cold rolled. All of the results in Table 5 for annealing at 1350° F. (about 732° C.) through 1450° F. (about 788° C.) for the listed times (referred to herein as a "mill anneal") indicate that the extrusions may be readily cold reduced to tube via rocking or pilgering or drawing. For example, those tensile results compare favorably with results obtained by the inventors from cold rolling and annealing Ti-4Al-2.5V-1.5Fe-0.25$O_2$, and also from the inventors' prior work with Ti-3Al-2.5V alloy, which is conventionally extruded to tubing.

The results in Table 5 for the water quenched and aged specimens (referred to as "STA" for "solution treated and aged") show that cold rocked/pilgered tube produced from the extrusions could be subsequently heat-treated to obtain much higher strengths, while maintaining some residual ductility. These STA properties are favorable when compared to those for Ti-6Al-4V and sub-grade variants.

Example 2

Additional billets of the hot-forged Kosaka alloy of Table 5 described above were prepared and successfully extruded to tubular hollows. Two sizes of input billets were utilized to obtain two sizes of extruded tubes. Billets machined to 6.69-inch outer diameter and 2.55-inch inner diameter were extruded to a nominal 3.4-inch outer diameter and 2.488-inch inner diameter. Two billets machined to 6.04-inch outer diameter and 2.25-inch inner diameter were extruded to a nominal 3.1-inch outer diameter and 2.25-inch inner diameter. The extrusion occurred at an aimpoint of 1450° F. (about 788° C.), with a maximum of 1550° F. (about 843° C.). This temperature range was selected so that the extrusion would take place at a temperature below the calculated $T_\beta$ (about 1790° F.) but also sufficient to achieve plastic flow.

The extruded tubes exhibited favorable surface quality and surface finish, were free from visible surface trauma, were of a round shape and generally uniform wall thickness, and had uniform dimensions along their length. These observation, taken in combination with the tensile results of Table 5 and the inventors' experience with cold rolling the same material, indicate that the tubular extrusions may be further processed by cold working to tubing meeting commercial requirements.

Example 3

Several coupons of the α-β titanium alloy of Table 5 hot forged as described in Example 1 above were rolled to about 0.225-inch thick in the α-β range at a temperature of 50-150° F. (about 28° C. to about 83° C.) below the calculated $T_\beta$. Experimentation with the alloy indicated that rolling in the α-β range followed by a mill anneal produced the best cold rolling results. However, it is anticipated that depending on the results desired, the rolling temperature might be in the range of temperatures below $T_\beta$ down to the mill anneal range.

Prior to cold rolling, the coupons were mill annealed, and then blasted and pickled so as to be free of a case and oxygen-enriched or stabilized surface. The coupons were cold rolled at ambient temperature, without application of external heat. (The samples warmed through adiabatic working to about 200-300° F. (about 93° C. to about 149° C.), which is not considered metallurgically significant.) The cold rolled samples were subsequently annealed. Several of the annealed 0.225-inch thick coupons were cold rolled to about 0.143-inch thickness, a reduction of about 36%, through several roll passes. Two of the 0.143-inch coupons were annealed for 1 hour at 1400° F. (760° C.) and then cold rolled at ambient temperature, without the application of external heat, to about 0.0765 inch, a reduction of about 46%.

During cold rolling of heavier thickness samples, reductions of 0.001-0.003 inch per pass were observed. At thinner gauges, as well as near the limits of cold reduction before annealing was required, it was observed that several passes were needed before achieving a reduction of as little as 0.001 inch. As will be evident to one having ordinary skill, the attainable thickness reduction per pass will depend in part on mill type, mill configuration, work roll diameter, as well as other factors. Observations of the cold rolling of the material indicate that ultimate reductions of at least approximately 35-45% could readily be achieved prior to the need for annealing. The samples cold rolled without observable trauma or defects except for slight edge cracking that occurred at the limit of the material's practical ductility. These observations indicated the suitability of the α-β Kosaka alloy for cold rolling.

Tensile properties of the intermediate and final gauge coupons are provided below in Table 6. These properties compare favorably with required tensile properties for Ti-6Al-4V material as set forth in standard industry specifications such as: AMS 4911 H (Aerospace Material Specification, Titanium Alloy, Sheet, Strip, and Plate 6Al-4V, Annealed); MIL-T-9046J (Table III); and DMS 1592C.

TABLE 6

| Material Thickness (inches) | Longitudinal Yield Strength (KSI) | Longitudinal Ultimate Tensile Strength (KSI) | Longitudinal Elongation (%) | Transverse Yield Strength (KSI) | Transverse Ultimate Tensile Strength (KSI) | Transverse Elongation (%) |
|---|---|---|---|---|---|---|
| 0.143 | 125.5 | 141.9 | 15 | 153.4 | 158.3 | 16 |
| 0.143 | 126.3 | 142.9 | 15 | 152.9 | 157.6 | 16 |
| 0.143 | 125.3 | 141.9 | 15 | 152.2 | 157.4 | 16 |
| 0.0765 | 125.6 | 145.9 | 14 | 150.3 | 157.3 | 14 |
| 0.0765 | 125.9 | 146.3 | 14 | 150.1 | 156.9 | 15 |

Bend properties of the annealed coupons were evaluated according to ASTM E 290. Such testing consisted of laying a flat coupon on two stationary rollers and then pushing the coupon between the rollers with a mandrel of a radius based upon material thickness until a bend angle of 105° is obtained. The specimen was then examined for cracking. The cold rolled specimens exhibited the capability of being bent into tighter radii (typically an achieved bend radius of 3T, or in some cases 2T, where "T" is specimen thickness) than is typical for Ti-6Al-4V material, while also exhibiting strength levels comparable to Ti-6Al-4V. Based on the inventors' observations of this and other bend testing, it is believed that many cold rolled articles formed of the Kosaka alloy may be bent around a radius of 4 times the article's thickness or less without failure of the article.

The cold rolling observations and strength and bend property testing in this example indicate that the Kosaka alloy may be processed into cold rolled strip, and also may be further reduced to very thin gauge product, such as foil. This was confirmed in additional testing by the inventors wherein a Kosaka alloy having the chemistry in the present example was successfully cold rolled on a Sendzimir mill to a thickness of 0.011 inch or less.

Example 4

A plate of an α-β processed Kosaka alloy having the chemistry in Table 4 above was prepared by cross rolling the plate at about 1735° F. (about 946° C.), which is in the range of 50-150° F. (about 28° C. to about 83° C.) less than $T_\beta$. The plate was hot rolled at 1715° F. (about 935° C.) from a nominal 0.980 inch thickness to a nominal 0.220 inch thickness. To investigate which intermediate anneal parameters provide suitable conditions for subsequent cold reduction, the plate was cut into four individual sections (#1 through #4) and the sections were processed as indicated in Table 7. Each section was first annealed for about one hour and then subjected to two cold rolling (CR) steps with an intermediate anneal lasting about one hour.

TABLE 7

| Section | Processing | Final Gauge (inches) |
|---|---|---|
| #1 | anneal @ 1400° F. (760° C.)/CR/ anneal @ 1400° F. (760° C.)/CR | 0.069 |
| #2 | anneal @ 1550° F. (about 843° C.)/CR/ anneal @ 1400° F. (760° C.)/CR | 0.066 |
| #3 | anneal @ 1700° F. (about 927° C.)/CR/ anneal @ 1400° F. (760° C.)/CR | 0.078 |
| #4 | anneal @ 1800° F. (about 982° C.)/CR/ anneal @ 1400° F. (760° C.)/CR | N/A |

During cold rolling steps, rolling passes were conducted until the first observable edge checking, which is an early indication that the material is approaching the limit of practical workability. As was seen in other cold rolling trials with the Kosaka alloy by the inventors, the initial cold reduction in the Table 7 trials was on the order of 30-40%, and more typically was 33-37%. Using parameters of one hour at 1400° F. (760° C.) for both the pre-cold reduction anneal and the intermediate anneal provided suitable results, although the processing applied to the other sections in Table 7 also worked well.

The inventors also determined that annealing for four hours at 1400° F. (760° C.), or at either 1350° F. (about 732° C.) or 1450° F. (about 787° C.) for an equivalent time, also imparted substantially the same capability in the material for subsequent cold reduction and advantageous mechanical properties, such as tensile and bending results. It was observed that even higher temperatures, such as in the "solution range" of 50-150° F. (about 28° C. to about 83° C.) less than $T_\beta$, appeared to toughen the material and make subsequent cold reduction more difficult. Annealing in the β field, $T>T_\beta$, yielded no advantage for subsequent cold reduction.

Example 5

A Kosaka alloy was prepared having following composition: 4.07 wt % aluminum; 229 ppm carbon; 1.69 wt % iron; 86 ppm hydrogen; 99 ppm nitrogen; 2100 ppm oxygen; and 2.60 wt % vanadium. The alloy was processed by initially forging a 30-inch diameter VAR ingot of the alloy at 2100° F. (about 1149° C.) to a nominal 20-inch thick by 29-inch wide cross-section, which in turn was forged at 1950° F. (about 1066° C.) to a nominal 10-inch thick by 29-inch wide cross-section. After grinding/conditioning, the material was forged at 1835° F. (about 1002° C.) (still above the $T_\beta$ of about 1790° F. (about 977° C.)) to a nominal 4.5-inch thick slab, which was subsequently conditioned by grinding and pickling. A section of the slab was rolled at 1725° F. (about 941° C.), about 65° F. (about 36° C.) below $T_\beta$, to about 2.1-inch thickness and annealed. A 12×15 inch piece of the 2.1-inch plate was then hot rolled to a hot band of nominal 0.2-inch thickness. After annealing at 1400° F. (760° C.) for one hour, the piece was blasted and pickled, cold rolled to about 0.143-inch thick, air annealed at 1400° F. (760° C.) for one hour, and conditioned. As is known in the art, conditioning may include one or more surface treatments, such as blasting, pickling and grinding, to remove surface scale, oxide and defects. The band was cold rolled again, this time to about 0.078-inch thick, and similarly annealed and conditioned, and re-rolled to about 0.045-inch thick.

On rolling to 0.078-inch thick, the resulting sheet was cut into two pieces for ease of handling. However, so as to perform further testing on equipment requiring a coil, the two pieces were welded together and tails were attached to the strip. The chemistry of the weld metal was substantially the same as the base metal. The alloy was capable of being welded using traditional means for titanium alloys, providing a ductile weld deposit. The strip was then cold rolled (the weld was not rolled) to provide a nominal 0.045-inch thick strip, and annealed in a continuous anneal furnace at 1425° F. (about 774° C.) at a feed rate of 1 foot/minute. As is known, a continuous anneal is accomplished by moving the strip through a hot zone within a semi-protective atmosphere including argon, helium, nitrogen, or some other gas having limited reactivity at the annealing temperature. The semi-protective atmosphere is intended to preclude the necessity to blast and then heavily pickle the annealed strip to remove deep oxide. A continuous anneal furnace is conventionally used in commercial scale processing and, therefore, the testing was carried out to simulate producing coiled strip from Kosaka alloy in a commercial production environment.

Samples of one of the annealed joined sections of the strip were collected for evaluation of tensile properties, and the strip was then cold rolled. One of the joined sections was cold rolled from a thickness of about 0.041 inch to about 0.022 inch, a 46% reduction. The remaining section was cold rolled from a thickness of about 0.042 inch to about 0.024 inch, a 43% reduction. Rolling was discontinued when a sudden edge crack appeared in each joined section.

After cold rolling, the strip was re-divided at the weld line into two individual strips. The first section of the strip was then annealed on the continuous anneal line at 1425° F. (about 774° C.) at a feed rate of 1 foot/minute. Tensile properties of the annealed first section of the strip are provided below in Table 8, with each test having been run in duplicate. The tensile properties in Table 8 were substantially the same as those of the samples collected from the first section of the strip after the initial continuous anneal and prior to the first cold reduction. That all samples had similar favorable tensile properties indicates that the alloy may be effectively continuous annealed.

TABLE 8

| | Longitudinal | | | Transverse | | |
|---|---|---|---|---|---|---|
| Test Run | Yield Strength (KSI) | Ultimate Tensile Strength (KSI) | Elongation (%) | Yield Strength (KSI) | Ultimate Tensile Strength (KSI) | Elongation (%) |
| #1 | 131.1 | 149.7 | 14 | 153.0 | 160.8 | 10 |
| #2 | 131.4 | 150.4 | 12 | 152.6 | 160.0 | 12 |

The cold rolling results achieved in this example were very favorable. Continuous annealing suitably softened the material for additional cold reduction to thin gauge. The use of a Sendzimir mill, which applies pressure more uniformly across the width of the workpiece, may increase the possible cold rolling prior to the necessity to anneal.

Example 6

A section of a billet of Kosaka alloy having the chemistry shown in Table 4 was provided and processed as follows toward the end of producing wire. The billet was forged on a forging press at about 1725° F. (about 941° C.) to a round bar about 2.75 inches in diameter, and then forged on a rotary forge to round it up. The bar was then forged/swaged on a small rotary swage in two steps, each at 1625° F. (885° C.), first to 1.25-inch diameter and then 0.75-inch diameter. After blasting and pickling, the rod was halved and one half was swaged to about 0.5 inch at a temperature below red heat. The 0.5-inch rod was annealed for 1 hour at 1400° F. (760° C.).

The material flowed very well during swaging, without surface trauma. Microstructural examination revealed sound structure, with no voids, porosity, or other defects. A first sample of the annealed material was tested for tensile properties and exhibited 126.4 KSI yield strength, 147.4 KSI ultimate tensile strength, and 18% total elongation. A second annealed bar sample exhibited 125.5 KSI yield strength, 146.8 KSI ultimate tensile strength, and 18% total elongation. Thus, the samples exhibited yield and ultimate tensile strengths similar to Ti-6Al-4V, but with improved ductility. The increased workability exhibited by the Kosaka alloy compared to other titanium alloys of similar strength, alloys which also require an increased number of intermediate heating and working steps and additional grinding to remove surface defects from thermo-mechanical processing trauma, represents a significant advantage.

Example 7

As discussed above, the Kosaka alloy was originally developed for use as ballistic armor plate. With the unexpected observation that the alloy may be readily cold worked and exhibits significant ductility in the cold-worked condition at higher strength levels, the inventors determined to investigate whether cold working affects ballistic performance.

A 2.1-inch (about 50 mm) thick plate of an α-β processed Kosaka alloy having the chemistry shown in Table 4 was prepared as described in Example 5. The plate was hot rolled at 1715° F. (935° C.) to a thickness of approximately 1.090 inches. The rolling direction was normal to the prior rolling direction. The plate was annealed in air at approximately 1400° F. (760° C.) for about one hour and then blasted and pickled. The sample was then rolled at approximately 1000° F. (about 538° C.) to 0.840 inch thick and cut into halves. One section was retained in the as-rolled condition. The remaining section was annealed at 1690° F. (about 921° C.) for approximately one hour and air cooled. (The calculated $T_\beta$ of the material was 1790° F. (about 977° C.).) Both sections were blasted and pickled and sent for ballistic testing. A "remnant" of equivalent thickness material of the same ingot also was sent for ballistic testing. The remnant had been processed in a manner conventionally used for production of ballistic armor plate, by a hot rolling, solution anneal, and a mill anneal at approximately 1400° F. (760° C.) for at least one hour. The solution anneal typically is performed at 50-150° F. (about 28° C. to about 83° C.) below $T_\beta$.

The testing laboratory evaluated the samples against a 20 mm Fragment Simulating Projectile (FSP) and a 14.5 mm API B32 round, per MIL-DTL-96077F. There was no discernable difference noted in the effects of the 14.5 mm rounds on each of the samples, and all test pieces were completely penetrated by the 14.5 mm rounds at velocities of 2990 to 3018 feet per second (fps). Results with the 20 mm FSP rounds are shown in Table 10 (MIL-DTL-96077F required $V_{50}$ is 2529 fps).

TABLE 10

| Material | Gauge (inches) | V50 (fps) | Shots |
|---|---|---|---|
| 1000° F. (about 538° C.) Roll + Anneal | 0.829 | 2843 | 4 |
| 1000° F. (about 538° C.) Roll, No Anneal | 0.830 | N/A | 3 |
| Hot Roll + Anneal (conventional) | 0.852 | 2782 | 4 |

As shown in Table 10, the material rolled at 1000° F. (about 538° C.) followed by a "solution range" anneal (nominal 1 hour at 1690° F. (about 921° C.) and air cooled) performed significantly better against the FSP rounds than the material rolled at 1000° F. (about 538° C.) that was not subsequently annealed, and against the material that was hot rolled and annealed in a manner conventional for ballistic armor formed from Kosaka alloy. Thus, the results in Table 10 indicate that utilizing rolling temperatures significantly lower than conventional rolling temperatures during production of ballistic armor plate from Kosaka alloy can lead to improved FSP ballistic performance.

Accordingly, it was determined that the $V_{50}$ ballistic performance of a Kosaka alloy plate having the nominal composition Ti-4Al-2.5V-1.5Fe-0.25$O_2$ with 20 mm FSP rounds was improved on the order of 50-100 fps by applying novel thermo-mechanical processing. In one form, the novel thermo-mechanical processing involved first employing relatively normal hot rolling below $T_\beta$ at conventional α-β hot working temperatures (typically, 50-150° F. (about 28° C. to about 83° C.) below $T_\beta$) in such a manner as to achieve nearly equal strain in the longitudinal and long transverse orientations of the plate. An intermediate mill anneal at about 1400° F. (760° C.) for approximately one hour was then applied. The plate was then rolled at a temperature significantly lower than is conventionally used to hot roll armor plate from Kosaka alloy. For example, it is believed that the plate may be rolled at 400-700° F. (222° C. to about 389° C.) below $T_\beta$, or at a lower temperature, temperatures much lower than previously believed possible for use with Kosaka alloy. The rolling may be used to achieve, for example, 15-30% reduction in plate thickness. Subsequent to such rolling, the plate may be annealed in the solution temperature range, typically 50-100° F. (about 28° C. to about 83° C.) below $T_\beta$, for a suitable time period, which may be, for example, in the range of 50-240 minutes. The resultant annealed plate may then be finished through combinations of typical metal plate finishing operations to remove the case of alpha (α) material. Such finishing operations may include, but are not limited to, blasting, acid pickling, grinding, machining, polishing, and sanding, whereby a smooth surface finish is produced to optimize ballistic performance.

It is to be understood that the present description illustrates those aspects of the invention relevant to a clear understanding of the invention. Certain aspects of the invention that would be apparent to those of ordinary skill in the art and that, therefore, would not facilitate a better understanding of the invention have not been presented in order to simplify the present description. Although embodiments of the present invention have been described, one of ordinary skill in the art will, upon considering the foregoing description, recognize that many modifications and variations of the invention may be employed. All such variations and modifications of the invention are intended to be covered by the foregoing description and the following claims.

What is claimed is:

1. A method of forming an article from an α-β titanium alloy, the α-β titanium alloy consisting essentially of, in weight percentages, from 2.9 to 5.0 aluminum, from 2.0 to 3.0 vanadium, from 0.4 to 2.0 iron, from 0.2 to 0.3 oxygen, from 0.005 to 0.3 carbon, from 0.001 to 0.02 nitrogen, from 0 to 0.1 chromium, from 0 to 0.1 nickel, incidental impurities, and titanium, the method consisting essentially of:

α-β working the α-β titanium alloy at a temperature greater than 1600° F. to provide the α-β titanium alloy with a microstructure conducive to subsequent cold deformation;

reducing a thickness of the α-β titanium alloy at a temperature in the range of ambient temperature to less than 1250° F. by a process comprising at least two cold rolling steps, wherein in at least one cold rolling step a thickness of the α-β titanium alloy is reduced by 30% to 60%; and annealing the α-β titanium alloy intermediate successive cold rolling steps and thereby reducing stresses within the α-β titanium alloy;

wherein the article has tensile strength of at least 120 ksi and ultimate tensile strength of at least 130 ksi.

2. The method of claim 1, wherein the cold rolling steps are conducted at a temperature that is no greater than 400° F. below the beta transus temperature of the alloy.

3. The method of claim 1, wherein the cold rolling steps are conducted at a temperature that is in the range of 700° F. below the beta transus temperature of the alloy to 400° F. below the beta transus temperature of the alloy.

4. The method of claim 1, wherein at least one anneal intermediate successive cold rolling steps is conducted on a continuous anneal furnace line.

5. A method of making a plate from an α-β titanium alloy, the α-β titanium alloy consisting essentially of, in weight percentages, from 2.9 to 5.0 aluminum, from 2.0 to 3.0 vanadium, from 0.4 to 2.0 iron, from 0.2 to 0.3 oxygen, from 0.005 to 0.3 carbon, from 0.001 to 0.02 nitrogen, from 0 to 0.1 chromium, from 0 to 0.1 nickel, incidental impurities, and titanium, the method consisting essentially of:

α-β working the α-β titanium alloy at a temperature greater than 1600° F. to provide the α-β titanium alloy with a microstructure conducive to subsequent cold deformation; and cold rolling the α-β titanium alloy at a temperature that is no greater than 400° F. below the beta transus temperature of the alloy;

wherein the plate has tensile strength of at least 120 ksi and ultimate tensile strength of at least 130 ksi.

6. The method of claim 5, wherein cold rolling the α-β titanium alloy comprises rolling the alloy at a temperature that is in the range of 700° F. below the beta transus temperature of the alloy to 400° F. below the beta transus temperature of the alloy.

7. The method of claim 5, wherein cold rolling the α-β titanium alloy includes at least two cold rolling steps with a mill anneal between successive cold rolling steps, wherein the annealing reduces stresses within the α-β titanium alloy.

8. The method of claim 7, wherein in at least one cold rolling step a thickness of the α-β titanium alloy is reduced by 30% to 60%.

9. A method of forming an article from an α-β titanium alloy, the α-β titanium alloy consisting essentially of, in weight percentages, from 2.9 to 5.0 aluminum, from 2.0 to 3.0 vanadium, from 0.4 to 2.0 iron, from 0.2 to 0.3 oxygen, from 0.005 to 0.3 carbon, from 0.001 to 0.02 nitrogen, from 0 to 0.1 chromium, from 0 to 0.1 nickel, incidental impurities, and titanium, the method consisting essentially of:

α-β working the α-β titanium alloy at a temperature greater than 1600° F. to provide the α-β titanium alloy with a microstructure conducive to subsequent cold deformation; and cold working the α-β titanium alloy at a temperature in the range of ambient temperature to less than 1250° F.;

wherein the article has tensile strength of at least 120 ksi and ultimate tensile strength of at least 130 ksi.

10. The method of claim 9, wherein cold working the α-β titanium alloy is conducted at a temperature in the range of ambient temperature up to 1000° F.

11. The method of claim 9, wherein cold working the α-β titanium alloy includes cold rolling the α-β titanium alloy, and wherein the article is selected from the group consisting of a bar, a sheet, a strip, a coil, and a plate.

12. The method of claim 9, wherein cold working the α-β titanium alloy includes reducing a thickness of the α-β titanium alloy by at least two cold rolling steps with a mill anneal between successive cold rolling steps, wherein the annealing reduces stresses within the α-β titanium alloy.

13. The method of claim 12, wherein at least one anneal intermediate successive cold rolling steps is conducted on a continuous anneal furnace line.

14. The method of claim 12, wherein in at least one of the cold rolling steps, a thickness of the α-β titanium alloy is reduced by 30% to 60%.

15. The method of claim 9, wherein cold working the α-β titanium alloy includes working the α-β titanium alloy at less than 1250° F. by at least one technique selected from the group consisting of rolling, forging, extruding, pilgering, rocking, drawing, flow-turning, liquid compressive forming, gas compressive forming, hydro-forming, bulge forming, roll forming, stamping, fine-blanking, die pressing, deep drawing, coining, spinning, swaging, impact extruding, explosive forming, rubber forming, back extrusion, piercing, stretch forming, press bending, electromagnetic forming, and cold heading.

16. The method of claim 9, wherein cold working the α-β titanium alloy includes at least one of pilgering and rocking the α-β titanium alloy, and wherein the article is one of a tube and a pipe.

17. The method of claim 9, wherein cold working the α-β titanium alloy includes drawing the α-β titanium alloy, and wherein the article is selected from the group consisting of a rod, a wire, a bar, and a tubular hollow.

18. The method of claim 9, wherein the article has a thickness up to 4 inches, and wherein room temperature properties of the article include elongation of at least 10%.

19. The method of claim 18, wherein the article has elongation of at least 12%.

20. The method of claim 9, wherein the article can be bent around a radius of 4 times its thickness without failure of the article.

21. The method of claim 9, wherein yield strength, ultimate tensile strength, and elongation properties of the article are each at least as great as for an identical article made of Ti-6Al-4V.

22. The method of claim 9, where the α-β titanium alloy has lower flow stress than Ti-6Al-4V alloy.

* * * * *